US006536787B1

(12) United States Patent
Shick

(10) Patent No.: US 6,536,787 B1
(45) Date of Patent: Mar. 25, 2003

(54) MULTI-WHEEL BASEPLATE AND BAGGAGE ASSEMBLY

(75) Inventor: Lawrence A. Shick, Boca Raton, FL (US)

(73) Assignee: Lifestyle International Inc., Secaucas, NJ (US)

( * ) Notice: Subject to any disclaimer, the term of this patent is extended or adjusted under 35 U.S.C. 154(b) by 0 days.

(21) Appl. No.: 09/690,413

(22) Filed: Oct. 17, 2000

Related U.S. Application Data

(63) Continuation-in-part of application No. 29/112,505, filed on Oct. 18, 1999, now Pat. No. Des. 438,011.

(51) Int. Cl.[7] ..... B62B 1/00

(52) U.S. Cl. ..... 280/47.24; 280/47.27; 280/62; 190/18 A; 248/129

(58) Field of Search ..... 280/79.11, 79.3, 280/79.7, 47.27, 47.28, 62, 47.131, 47.2, 47.24, 645, 651, 652, 43.1; 190/18 A; 248/128, 129, 130, 98

(56) References Cited

U.S. PATENT DOCUMENTS

| | | | | | |
|---|---|---|---|---|---|
| 1,422,730 | A | * | 7/1922 | Wood | 280/79.11 |
| 1,788,150 | A | * | 1/1931 | Curtin | 280/79.11 |
| 2,375,338 | A | * | 5/1945 | Alexander | 280/63 |
| 2,509,575 | A | * | 5/1950 | Mingo | 280/79.11 |
| 2,696,990 | A | * | 12/1954 | Davis | 280/47.131 |
| 3,580,601 | A | * | 5/1971 | Miles | 280/47.131 |
| 3,717,228 | A | | 2/1973 | Blair | 190/1 |
| 4,488,733 | A | * | 12/1984 | Hellsten | 280/47.2 X |
| 4,771,871 | A | * | 9/1988 | Lambrecht | |
| 4,772,035 | A | * | 9/1988 | Danial | |
| 5,048,649 | A | | 9/1991 | Carpenter et al. | 190/18 A |
| 5,109,961 | A | * | 5/1992 | Bergman | 190/18 A |
| 5,253,739 | A | | 10/1993 | King | 190/18 A |
| 5,291,976 | A | | 3/1994 | Ku | 190/18 A |
| 5,323,887 | A | | 6/1994 | Scicluna et al. | 190/18 A |
| 5,379,870 | A | * | 1/1995 | Sadow | 190/18 A |
| 5,498,010 | A | * | 3/1996 | Stube | |
| D370,997 | S | | 6/1996 | Hsieh | D3/318 |
| 5,524,920 | A | * | 6/1996 | Tsai | 280/652 |
| 5,575,362 | A | * | 11/1996 | Franklin et al. | 190/18 A X |
| 5,645,146 | A | | 7/1997 | Biebler et al. | 190/18 A |
| 5,653,319 | A | | 8/1997 | Wang | 190/115 |
| D384,206 | S | | 9/1997 | Wang | D3/321 |

(List continued on next page.)

FOREIGN PATENT DOCUMENTS

| | | | |
|---|---|---|---|
| FR | 821263 | * | 8/1937 |
| FR | 899995 | * | 9/1944 |
| FR | 1292341 | * | 3/1962 |
| FR | 1367421 | * | 6/1994 |

OTHER PUBLICATIONS

US Patent Application Publication US 2002/0125669—dated Sep. 2002.*

*Primary Examiner*—Brian L. Johnson
*Assistant Examiner*—Bryan Fischmann
(74) *Attorney, Agent, or Firm*—Darby & Darby

(57) ABSTRACT

A baseplate for an article of baggage, e.g., luggage. The baseplate includes a support member and three or more wheels disposed on the support member along a substantially linear axis and arranged so that adjacent wheels are substantially equidistant to one another. This advantageously provides greater stability to the baggage while distributing the load substantially equally. The invention also relates to an assembly in which the baseplate is mounted to an exterior surface of an article of baggage and pivotable about the substantially linear axis when tilted so as to roll along all three wheels. In one embodiment, the baseplate has three wheels including two outer wheels and an intermediate wheel disposed therebetween. The diameter of the two outer wheels is the same and larger than that of the diameter of the intermediate wheel.

35 Claims, 6 Drawing Sheets

U.S. PATENT DOCUMENTS

| | | | | | |
|---|---|---|---|---|---|
| 5,765,843 | A | * | 6/1998 | Miller | 280/79.7 |
| 5,782,325 | A | * | 7/1998 | O'Shea et al. | 190/18 A |
| 5,863,061 | A | | 1/1999 | Ziegler et al. | 280/642 |
| 5,903,956 | A | | 5/1999 | Theising | 16/19 |
| D414,933 | S | | 10/1999 | Yu | D3/282 |
| 6,062,357 | A | | 5/2000 | Bogert | 190/18 A |
| 6,176,357 | B1 | * | 1/2001 | Kuo | 190/18 A |
| D438,011 | S | * | 2/2001 | Shick | |
| 6,454,065 | B1 | * | 9/2002 | Chen | 190/18 A |

* cited by examiner

MULTI-WHEEL BASEPLATE AND BAGGAGE ASSEMBLY

CROSS-REFERENCE TO RELATED APPLICATIONS

This application is a continuation-in-part of U.S. patent application Ser. No. 29/112,505 filed on Oct. 18, 1999, now U.S. Pat. No. Des. 438,011 the disclosure of which is incorporated herein by reference in its entirety.

BACKGROUND OF THE INVENTION

1. Field of the Invention

The present invention relates generally to baggage, and in particular, to a multi-wheeled baseplate and baggage assembly.

2. Description of Related Art

Heavy luggage burdens travelers by placing a strain on the body and reducing maneuverability. To remedy these problems, luggage with pull handles and two wheels are commonly used by travelers to assist in transporting their belongings. The two wheels are generally mounted to the underside or corners of the luggage with the pull handle disposed at the opposite end, whereby the user pivots the luggage on its wheels and pulls the luggage from behind.

Conventional two wheel luggage assemblies are disadvantageous in that heavy loads produce a significant amount of pressure and friction that over time deform and mutilate the wheels thereby significantly shortening their useful life. Deformed or mutilated wheels roll unevenly causing the luggage to teeter and topple even over relatively smooth terrains. Aside from being a nuisance and slowing down the traveler's pace, luggage in this deteriorated state is prone to further damage, for example, scuffing or tearing, each time it tips over.

Heretofore, in order to improve the stability of two wheeled luggage assemblies, especially when rolled over uneven surfaces or terrain, a larger diameter wheel has been employed. This solution is disadvantageous in that the larger diameter wheel takes up more of the limited space in the interior compartment of the luggage and is exposed and thus more prone to damage while being handled by attendants. Another solution is to increase the distance of separation between the two wheels disposed proximate opposite ends of the baseplate. Due to the heavy load placed upon the wheels and the lack of support in the center of the baseplate between the wheels, the load generally places an undesirable force on the wheels towards the center of the luggage thereby causing the wheels to become distorted and turn inwards. As a result, the wheels rub within their respective recesses and roll unevenly. This result significantly slows down the traveler and hampers maneuverability.

It is therefore desirable to develop a baggage assembly that solves the aforementioned problems.

SUMMARY OF THE INVENTION

The term "baggage" as used herein is defined as any container used to hold something, such as a piece of luggage, duffle bag, attache, briefcase, or knapsack.

An object of the present invention is to provide a baseplate and baggage assembly that more evenly distributes the load so as to improve maneuverability.

Another objective of the present invention is to provide a baseplate and baggage assembly that reduces the friction and increases the life span of the wheels.

One embodiment of the present invention is directed to a baseplate for an article of baggage. The baseplate includes a substantially planar upper support member and at least three wheels disposed on the support member along a substantially linear axis and arranged so that adjacent wheels are substantially equidistant to one another. This advantageously provides greater stability to the baggage while substantially equally distributing the load.

In an alternative embodiment, the invention relates to an assembly in which the baseplate described above is mounted to an exterior surface of an article of baggage.

Other objects and features of the present invention will become apparent from the following detailed description considered in conjunction with the accompanying drawings. It is to be understood, however, that the drawings are designed solely for the purposes of illustration and not as a definition of the invention, for which reference should be made to the appended claims.

BRIEF DESCRIPTION OF THE DRAWINGS

The foregoing and other features of the present invention will be more readily apparent from the following detailed description and drawings of illustrative embodiments of the invention wherein like reference numbers refer to similar elements throughout the several views and in which.

DETAILED DESCRIPTION OF THE PREFERRED EMBODIMENTS

Figure 1:
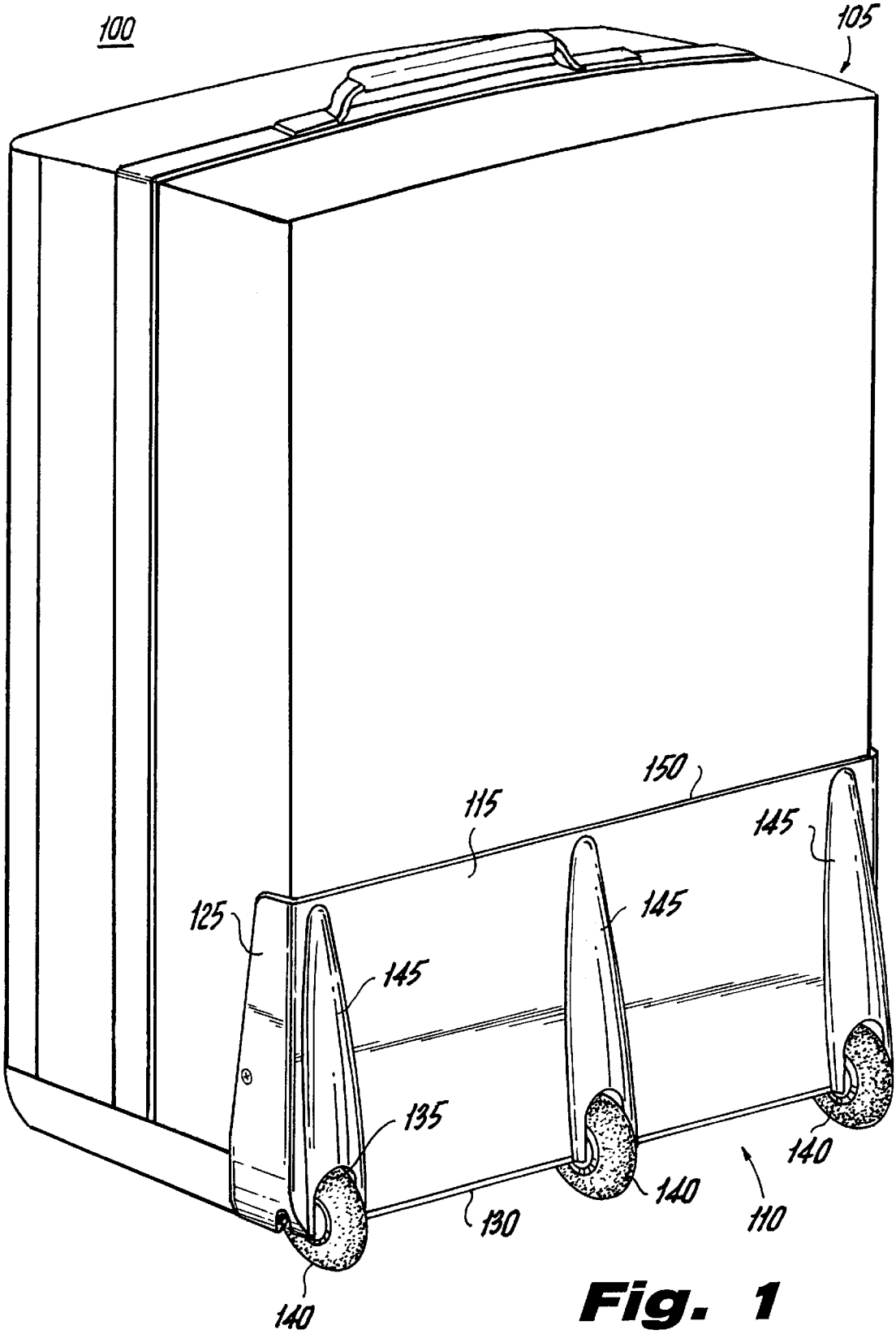
FIG. 1 is a perspective view of a first embodiment of a luggage and baseplate assembly in accordance with the present invention.
Figure 2:
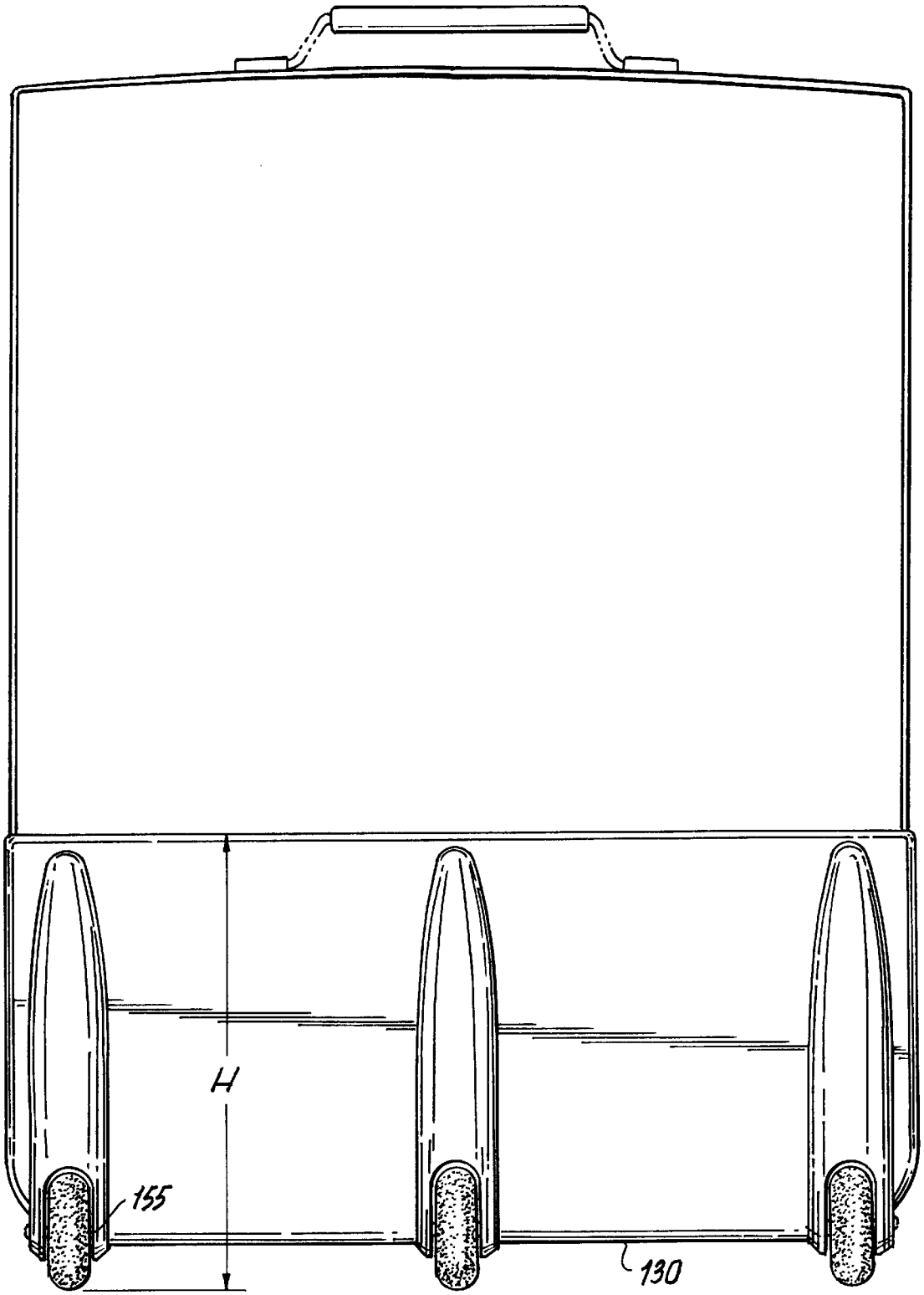
FIG. 2 is a rear view of the luggage and baseplate assembly of FIG. 1.
Figure 3:
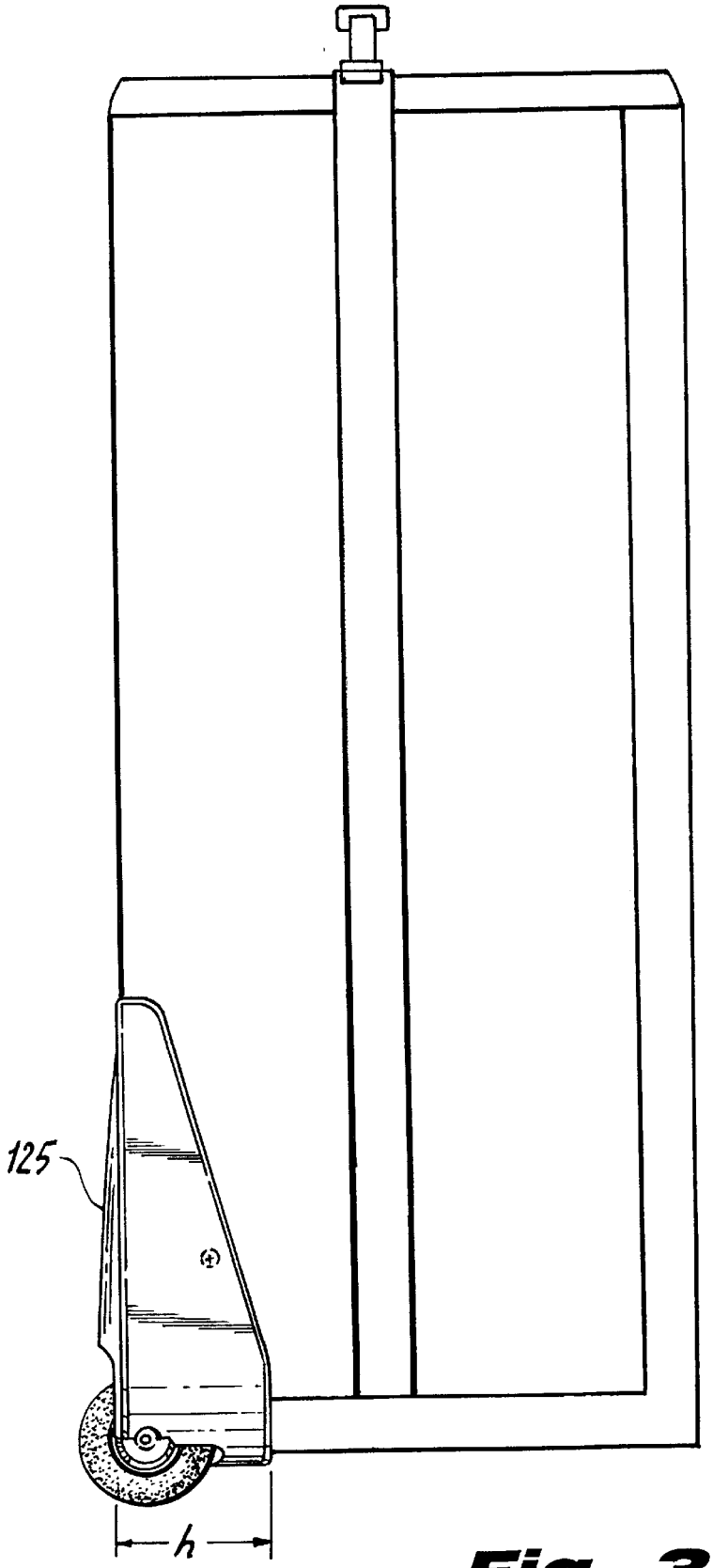
FIG. 3 is a side view of the luggage and baseplate assembly of FIG. 1.
Figure 4:
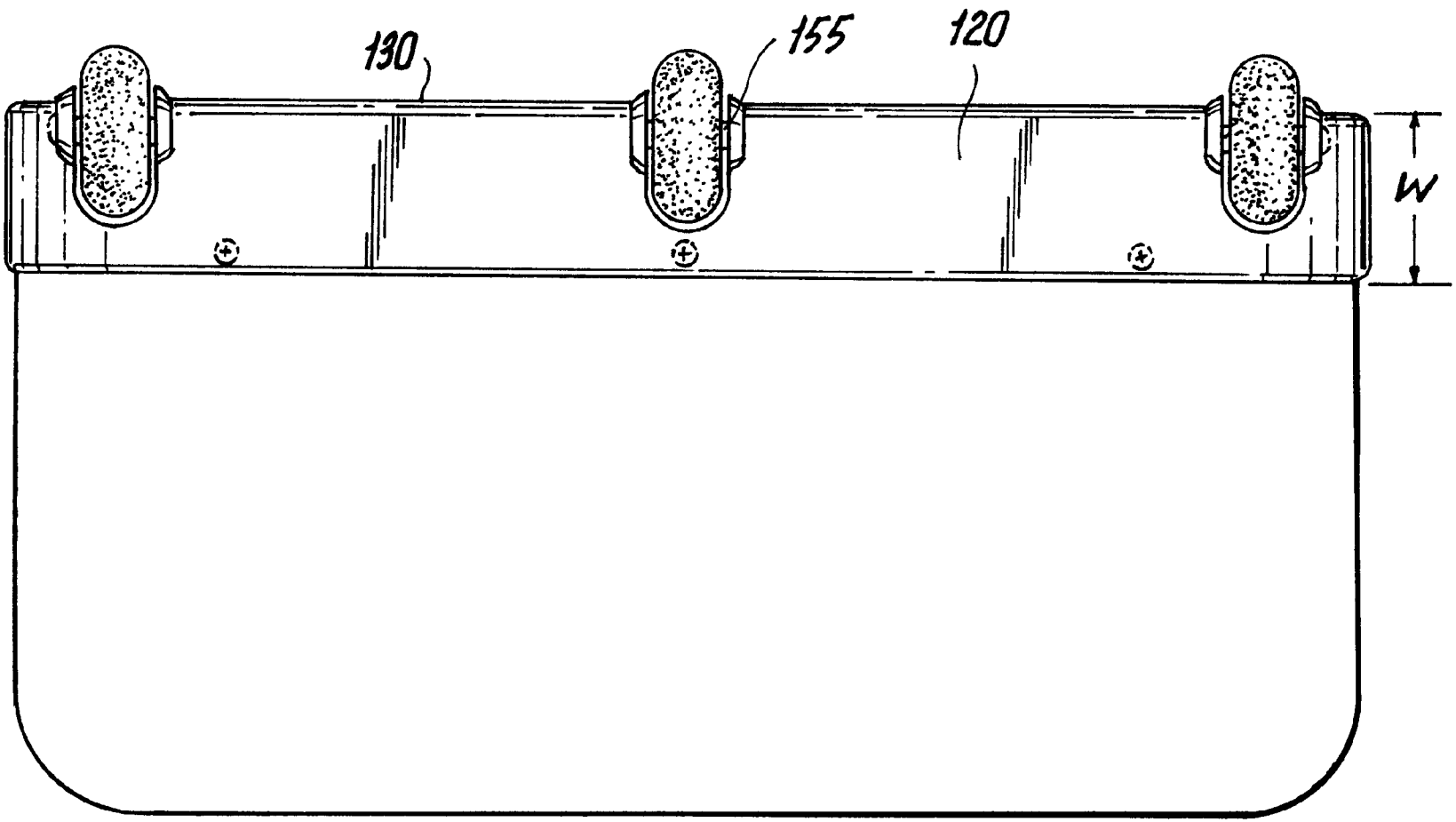
FIG. 4 is a bottom view of the luggage and baseplate assembly of FIG. 1.

A first embodiment of a three-wheel baseplate and baggage assembly 100 is shown in FIGS. 1–5. Assembly 100 includes a unitary baseplate 110 attached to a piece of baggage 105. By way of example, baggage 105 is shown in FIGS. 1–5 as a rectangular piece of luggage, however, the baggage may have a different shape or size. Baggage 105 may be made of a durable, rigid material (e.g. plastic), a soft material (e.g. fabric or cloth), or a combination thereof. Baseplate 110 (FIG. 5) includes an upper supporting member 115 and a lower supporting member 120 with an interface 130 formed therebetween. In the first embodiment shown in FIGS. 1–5, interface 130 is a substantially linear edge. Two side support members 125 are arranged substantially perpendicular with respect to both the upper and lower support members 115, 120 thereby forming a comer at the intersection thereof. Side support members 125 may be eliminated altogether thereby decreasing the overall weight at the expense of less protection of the exterior surface of the luggage 105.

Baseplate 110 including supporting members 115, 120, 125 preferably are formed as a unitary construction. By way of example, the unitary baseplate may be manufactured from an extruded or molded material that is durable, relatively inexpensive and lightweight, such as a polymer or plastic.

Alternatively, baseplate 110 may be two or more separate components attached or secured to one another using any conventional technique, for example, via screws or adhesive. In a preferred embodiment, the height "H" of the upper supporting member 115 is greater than the height "h" of the lower 'supporting member 120 so as to protect the exterior surface of the baggage when being tilted and rolled.

In the first embodiment shown in FIGS. 1–5, baseplate 110 has three wheels 140 so as to reduce the load on each wheel compared to a conventional two wheel baggage assembly. A channel is defined in a portion of the upper supporting member 115 and extends around the interface 130 to the lower supporting member 120 to form a recesses 135 in the baseplate 110 for receiving a wheel 140. Recesses 135 act as a safety guard for the wheels 140. In a preferred embodiment, recesses 135 defined in the baseplate 110 do not extend beyond its interior surface 160 (FIG. 5) and into the interior space of the article of luggage 105. Furthermore, when the baggage and baseplate assembly 100 is pulled over uneven terrain, the recesses 135 allow the caught material to free itself without being entangled in the wheels. Recesses 135 are defined along interface 130 with one recess proximate each end of the baseplate 110 and a third located therebetween so that adjacent recesses are substantially equidistant from one another.

Each wheel 140 is received in an associated recess 135 and rotatably mountable therein via a shaft 155. In a preferred embodiment, all three wheels 140 are rotatably mounted about a single shaft 155 that extends substantially the width of and is enclosed within the baseplate 110 so as to provide additional support and prevent damage to the shaft when transporting the baggage. Alternatively, separate shafts may be used to rotatably support respective wheels 140.

Ribs 145 project outwardly from an exterior non-contacting surface of the upper supporting member 115 and preferably extend from the recess 135 towards the top edge 150 of the upper supporting member 115. The ribs 145 serve as bumpers to protect the baggage 105 from damage when being tilted and rolled. It is within the scope of the present invention to modify the number, arrangement and/or shape of the ribs, as desired.

Figure 5:
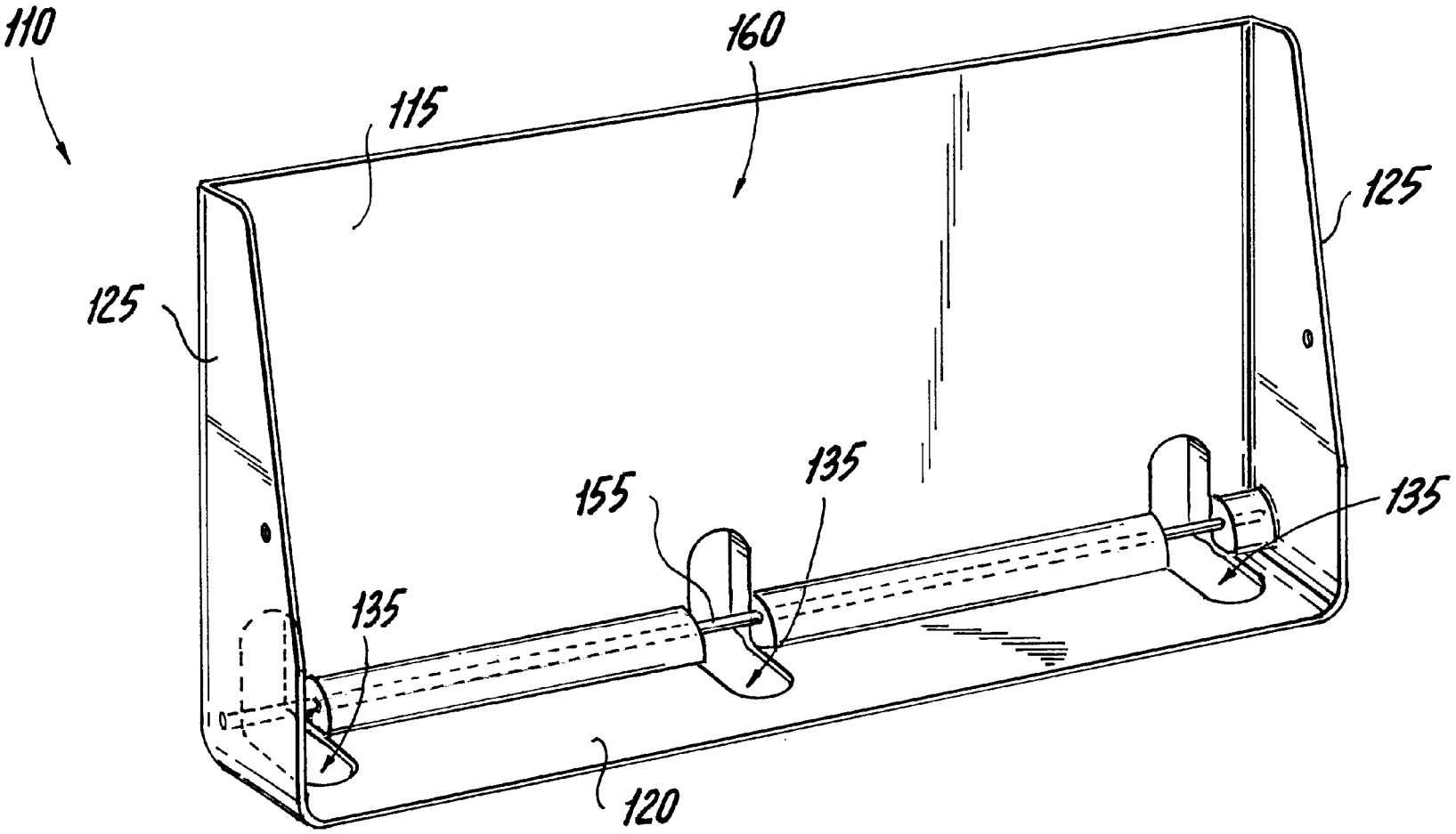
FIG. 5 is a perspective view of the baseplate in FIG. 1.

As shown in FIG. 5, the interior contacting surface 160 of the baseplate 110 is preferably complementary in shape to that portion of the baggage to which it is to be attached. Because the baggage 105 in accordance with the first embodiment and shown in FIGS. 1–4 is rectangular in shape, the interior contacting surface 160 of the baseplate 110 is constructed to form a substantially 90 degree angle between the upper and lower support members 115, 120.

Figure 6:
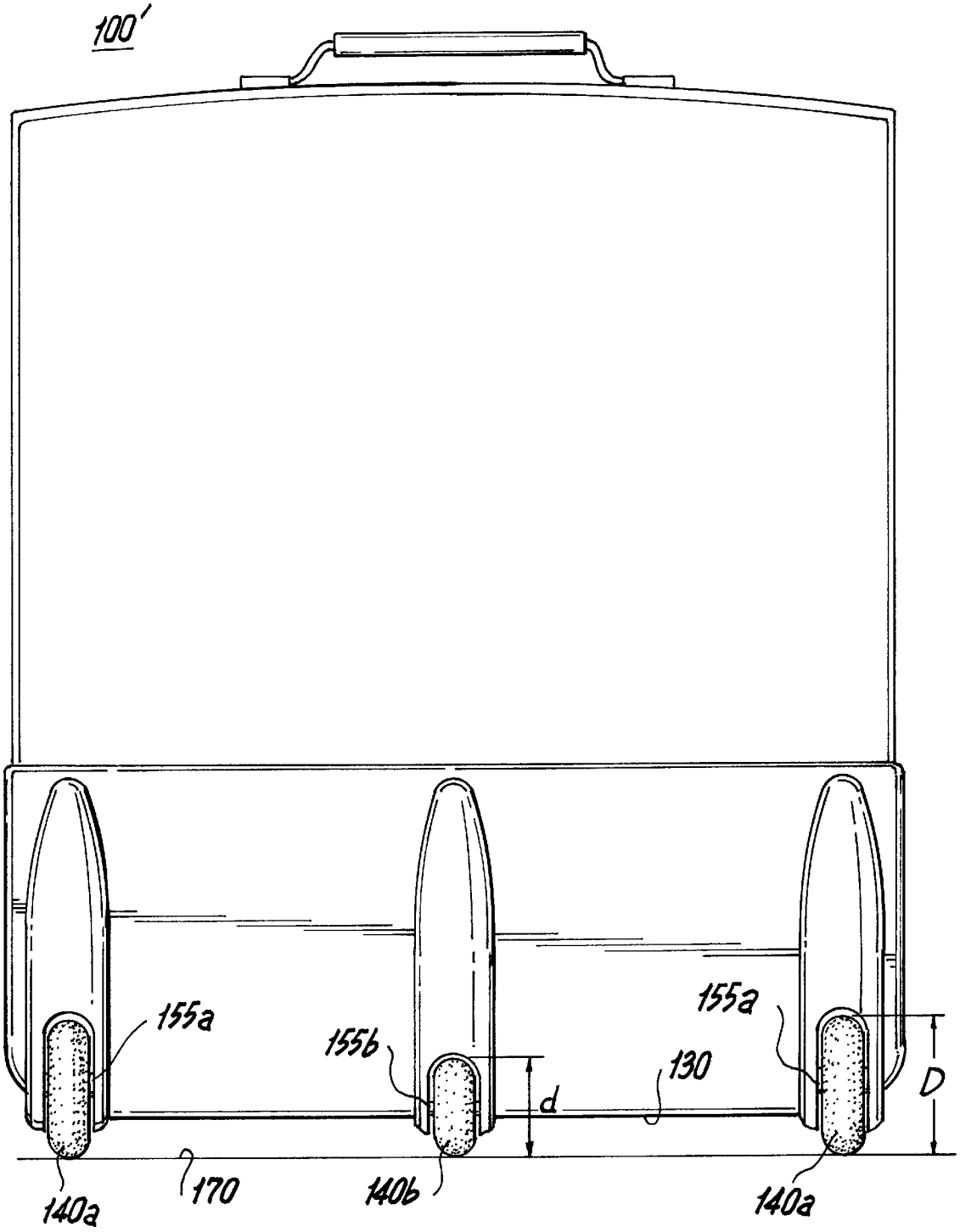
FIG. 6 is a rear view of a second embodiment of a luggage and baseplate assembly in accordance with the present invention.

FIG. 6 is an alternative embodiment of the baggage and baseplate assembly 100' in accordance with the present invention wherein the wheels 140*a*, 140*b* differ in diameter. In particular, the outer wheels 140*a* have a diameter "D" which is larger than that of the diameter "d" of intermediate wheel 140*b*. Wheels 140*a* are rotatably mounted about shaft 155*a* which is substantially parallel to shaft 155*b* about which intermediate wheel 140*b* is rotatably mounted. Shaft 155*a* may be a common shaft or two separate shafts. The two shafts 155 are separated by a predetermined distance relative to one another so that the exterior surface of the wheels lie in the same plane 170. Accordingly, all three wheels 140*a*, 140*b* will roll even along a substantially planar surface. This alternative construction improves the overall symmetry of motion of the baseplate and baggage assembly 100'.

Although the present invention has been shown and described as a baseplate having three wheels, it is contemplated and within the intended scope of the invention to design the baseplate 110 to have more than three wheels. Irrespective of the number of wheels, adjacent wheels are disposed substantially equidistant from one another in order to evenly distribute the load. The wheels shown in FIGS. 1–5 are protected within recesses defined in the baseplate. In an alternative embodiment, wheel assemblies may be mounted to the exterior surface of the baseplate.

By way of example, the present invention has been shown and described with respect to a rectangular piece of luggage, however, any size or shape luggage may be used. It is also contemplated and within the intended scope of the present invention for the baseplate to be mounted on other articles of baggage.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements which perform substantially the same function, in substantially the same way, to achieve the same results are within the scope of the invention. Substitutions of elements from one described embodiment to another are also fully intended.and contemplated. It is also to be understood that the drawings are not necessarily drawn to scale, but that they are merely conceptual in nature. It is the intention, therefore, to be limited only as indicated by the scope of the claims appended hereto.

What is claimed is:

1. A baseplate for a bag, comprising:

a support member including a substantially planar upper support portion, a substantially planar lower support portion disposed substantially perpendicular to said upper support portion, and two substantially planar side support portions disposed on opposite corners of a base of said bag, the upper support portion and the lower support portion extending along an entire edge of said bag base and uniting with each side support portion on opposite corners of said bag base;

three wheels being supported by said support member along a substantially linear axis along the bag base and arranged so that adjacent wheels are substantially equidistant to one another, said upper and lower support portions have a plurality of recesses defined therein extending from said upper support portions and into said lower support portion, each wheel having an associated recess; and, wherein the union of the upper, lower, and side support portions is substantially seamless.

2. The baseplate in accordance with claim 1, wherein said side, upper and lower support portions are a molded construction substantially seamless in construction.

3. The baseplate in accordance with claim 1, further comprising a shaft disposed so as to pass through each of said recesses, said wheels being received in respective recesses and rotatably mountable about said shaft.

4. The baseplate in accordance with claim 1, further comprising a plurality of shafts equal in number to said recesses, each shaft being dimensioned so as to pass through a respective recess, said wheels being received in respective recesses and rotatably mounted about a respective shaft.

5. The baseplate in accordance with claim 1, wherein each of said wheels has a predetermined diameter, the diameter of said wheels all being substantially equal.

6. The baseplate in accordance with claim 1, wherein each of said wheels has a predetermined diameter, the diameter of at least two of said wheels being unequal.

7. The baseplate in accordance with claim 1, wherein said three wheels comprise two outer wheels and an intermediate wheel disposed therebetween.

8. The baseplate in accordance with claim 7, wherein each of said three wheels has a predetermined diameter and an exterior surface, the diameter of said two outer wheels being substantially equal.

9. The baseplate in accordance with claim 8, wherein the diameter of said outer wheels is larger than the diameter of said inner wheel.

10. The baseplate in accordance with claim 8, wherein said three wheels are disposed so that the exterior surface of each of said three wheels lie in a common plane.

11. The baseplate in accordance with claim 1, wherein said side support member is substantially perpendicular to said upper and lower support members.

12. An assembly, comprising:

a bag having an exterior surface; and a baseplate mounted to the exterior surface of said bag, said baseplate comprising:

a support member including a substantially planar upper support portion, a substantially planar lower support portion disposed substantially perpendicular to said upper support portion, said upper support portions extending along a base of the bag and seamlessly uniting with said lower support portions extending along the bag base and two substantially planar side support portions each side support portion arranged on an opposite corner of a bag, said upper support portion and said lower support portion extending along the bag base and uniting with each side support portion on opposite corners of the bag base; and three wheels being supported by said support member along a substantially linear axis and arranged so that adjacent wheels are substantially equidistant to one another, said upper and lower support portions have a plurality of recesses defined therein extending from said upper support portion around the interface and into said lower support portion, each wheel having an associated recess.

13. The assembly in accordance with claim 12, wherein said baseplate is substantially seamless in construction.

14. The assembly in accordance with claim 11, further comprising a shaft disposed in said baseplate substantially parallel to said linear edge and passing through each of said recesses, said wheels being received in respective recesses and rotatably mountable about said shaft.

15. The assembly in accordance with claim 12, further comprising a plurality of shafts equal in number to said recesses, each shaft being dimensioned so as to pass through an associated recess, said wheels being received in respective recesses and rotatably mounted about a respective shaft.

16. The assembly in accordance with claim 12, wherein one of said wheels is disposed proximate each end of said baseplate.

17. The assembly in accordance with claim 12, said baseplate is pivotable about said substantially linear axis when said assembly is tilted so as to roll along all of said wheels.

18. The assembly in accordance with claim 12, wherein each of said wheels has a predetermined diameter, the diameter of said wheels all being substantially equal.

19. The assembly in accordance with claim 12, wherein each of said wheels has a predetermined diameter, the diameter of at least two of said wheels being unequal.

20. The assembly in accordance with claim 12, wherein said three wheels comprises two outer wheels and an intermediate wheel disposed therebetween.

21. The assembly in accordance with claim 20, wherein each of said three wheels has a predetermined diameter and an exterior surface, the diameter of said two outer wheels being substantially equal.

22. The assembly in accordance with claim 21, wherein the diameter of said outer wheels is larger than the diameter of said inner wheel.

23. The assembly in accordance with claim 21, wherein said three wheels are disposed so that the exterior surface of each of said three wheels lie in a common plane.

24. The assembly in accordance with claim 12, wherein said side support member is substantially perpendicular to said upper and lower support members.

25. The assembly according in accordance with claim 12, said baseplate is pivotable about said substantially linear axis when said assembly is tilted so as to roll along only two of said three wheels.

26. A baseplate for an article of baggage having a back panel and a support member attached along an edge of the back panel:

a support member having an upper support portion, a lower support portion, and two side support portions, the upper, lower and side support portions seamlessly joined at an interface, the support member attached to an edge of a back panel of an article of baggage, the edge having two opposing corners, the upper support portion and the lower support portion extending between the two opposing corners, each side support portion seamlessly joining the upper and lower support portion at one of the opposing corners; and three wheels in total, supported by the support member along the edge of a back panel and arranged so that adjacent wheels are substantially equidistant to one another, the upper and lower support portions having a plurality of recesses defined therein extending from the upper support portions and into the lower support portion, each wheel having an associated recess.

27. A baseplate as in claim 26 wherein the upper, lower, and side support portions are molded into a'substantially seamless baseplate construction.

28. The baseplate in accordance with claim 26, further comprising a shaft disposed so as to pass through each of said recesses, said wheels being received in respective recesses and rotatably mountable about said shaft.

29. The baseplate in accordance with claim 26, further comprising a plurality of shafts equal in number to said recesses, each shaft being dimensioned so as to pass through a respective recess, said wheels being received in respective recesses and rotatably mounted about a respective shaft.

30. The baseplate in accordance with claim 26, wherein each of the wheels has a predetermined diameter, the diameter of the wheels all being substantially equal.

31. The baseplate in accordance with claim 26, wherein each of the wheels has a predetermined diameter, the diameter of at least two of the wheels being unequal.

32. The baseplate in accordance with claim 26, wherein the baseplate comprises at least two outer wheels and an intermediate wheel disposed therebetween wherein a total number of outer wheels and a total number of intermediate wheels equals an odd number of wheels.

33. The baseplate in accordance with claim 32, wherein each of the wheels has a predetermined diameter and an exterior surface, the diameter of the outer wheels being substantially equal.

34. The baseplate in accordance with claim 26, wherein the diameter of the outer wheels is larger than the diameter of the inner wheel.

35. The baseplate in accordance with claim 26, wherein the wheels are disposed so that the exterior surface of each of the wheels lie in a common plane.

* * * * *